US010053279B2

(12) United States Patent
Draghetti

(10) Patent No.: US 10,053,279 B2
(45) Date of Patent: Aug. 21, 2018

(54) PACKET FOR SMOKING ARTICLES

(71) Applicant: GIMA TT S.P.A., Ozzano Dell'emilia (IT)

(72) Inventor: Fiorenzo Draghetti, Medicina (IT)

(73) Assignee: GIMA TT S.P.A., Ozzano Dell'Emilia (IT)

( * ) Notice: Subject to any disclaimer, the term of this patent is extended or adjusted under 35 U.S.C. 154(b) by 75 days.

(21) Appl. No.: 15/118,688

(22) PCT Filed: Feb. 13, 2015

(86) PCT No.: PCT/IB2015/051078

§ 371 (c)(1),
(2) Date: Aug. 12, 2016

(87) PCT Pub. No.: WO2015/121831

PCT Pub. Date: Aug. 20, 2015

(65) Prior Publication Data

US 2017/0050796 A1 Feb. 23, 2017

(30) Foreign Application Priority Data

Feb. 14, 2014 (IT) ..... MI2014A0226
Mar. 31, 2014 (IT) ..... BO2014A0177

(51) Int. Cl.
*A24F 15/00* (2006.01)
*B65D 85/10* (2006.01)
(Continued)

(52) U.S. Cl.
CPC ..... *B65D 85/1054* (2013.01); *A24F 15/00* (2013.01); *B65D 5/5028* (2013.01); *B65D 5/6682* (2013.01); *B65D 85/1009* (2013.01)

(58) Field of Classification Search
CPC ..... B65D 85/1054; B65D 5/5028; B65D 85/1009; A24F 15/00
(Continued)

(56) References Cited

U.S. PATENT DOCUMENTS 1,902,963 A 3/1933 Lepage et al.
3,858,788 A * 1/1975 Phillips, Jr. ..... B65D 5/62 206/268
(Continued)

FOREIGN PATENT DOCUMENTS

CN 2483353 Y 3/2002
DE 1 285 948 12/1964
(Continued)

OTHER PUBLICATIONS

International Search Report, PCT/IB2015/051078, dated May 21, 2015.

*Primary Examiner* — Rafael Ortiz
(74) *Attorney, Agent, or Firm* — Hamre, Schumann, Mueller & Larson, P.C.

(57) ABSTRACT

Packet for smoking articles, comprising an external shell and an internal shell to contain smoking articles. The external shell comprises an external containing body, a closing lid hinged to the internal shell and a connection tongue configured to connect the closing lid to the external containing body. Moreover, the internal shell is configured to slide, with respect to the external containing body, between a closed configuration where the internal shell is completely inserted inside the external shell, and an open and extracted configuration where the internal shell is partly extracted from the external containing body.

9 Claims, 15 Drawing Sheets

(51) Int. Cl.
*B65D 85/12* (2006.01)
*B65D 5/50* (2006.01)
*B65D 5/66* (2006.01)

(58) Field of Classification Search
USPC ..... 206/259, 261, 265, 268, 91, 242, 250, 206/252, 262, 270, 271
See application file for complete search history.

(56) References Cited

U.S. PATENT DOCUMENTS

| | | | | |
|---|---|---|---|---|
| 2005/0103654 | A1* | 5/2005 | Hennessy | B65D 85/1054 206/270 |
| 2005/0199517 | A1* | 9/2005 | Petrucci | B65D 5/4291 206/261 |
| 2010/0320101 | A1* | 12/2010 | Biondi | B65D 5/543 206/268 |

FOREIGN PATENT DOCUMENTS

| | | | | |
|---|---|---|---|---|
| GB | 568649 | | 9/1944 | |
| WO | 2007/065514 | A1 | 6/2007 | |
| WO | 2007/144043 | A1 | 12/2007 | |
| WO | 2009/125240 | A1 | 10/2009 | |
| WO | 2011/058414 | A1 | 5/2011 | |
| WO | 2011/092567 | A1 | 8/2011 | |
| WO | 2012/025757 | A1 | 3/2012 | |
| WO | WO 2012025757 | A1 * | 3/2012 | B65D 85/1054 |
| WO | 2013/068951 | A1 | 5/2013 | |
| WO | 2013/068959 | A1 | 5/2013 | |

* cited by examiner

PACKET FOR SMOKING ARTICLES

FIELD OF THE INVENTION

The present invention concerns a packet for smoking articles, such as, for example but not only, cigarettes.

BACKGROUND OF THE INVENTION

Packets of the rigid type for cigarettes are known, with a hinged closing lid, known as "hinged lid". These are generally easy to produce starting from a conventional blank, that is, from a sheet of material such as cardboard, paper or suchlike, suitably shaped and worked, and are easy and practical to use, protecting the cigarettes inside them.

Traditional cigarette packets have a rectangular parallelepiped shape, that extends along a longitudinal axis, and comprise a rigid external shell defining an external containing body and a lid hinged to the external containing body by means of a hinge. In traditional packets, the closing lid remains completely outside the external containing body when the packet is closed.

These "hinged lid" rigid packets are particularly appreciated by some types of smokers thanks to their high level of rigidity, which prevents damage to the cigarettes even when the packet is subjected to knocks or is kept in a pocket or bag of the consumer.

Changes in the habits of smokers and in regulations have generated a need to increase the space available to insert messages, drawings or promotional messages.

Some smokers are conservative creatures of habit and so they look diffidently on packets that have shapes and modes of use that are different from traditional rigid packets.

In particular, rigid packets for cigarettes are also known, of the type with sliding opening, known as "hinged-lid slide-open", in which there are two containers or shells, an external shell comprising an external containing body, and an internal shell. The internal shell in turn contains an organized group of cigarettes wrapped in a wrapper or sheet.

The internal shell is housed inside the external containing body, with respect to which it is configured to slide between a closed configuration, in which the internal shell is completely inserted inside the external containing body, and an open configuration, in which the internal shell is partly extracted from the external containing body. In this type of packet, compared with traditional rigid ones, there is a greater surface available for writings, drawings or promotional messages in general. Moreover, this type of packet can be used both in a new way, that is, by removing the internal shell, and also in a traditional way, thus keeping both more innovative smokers and conservative smokers happy.

A packet of this type is described for example in WO-A-2007/065514. This packet allows to increase the space available for promotional messages, since such messages can be printed both on the external shell and also on the internal shell. However, due to its very configuration and construction, the packet has to be produced starting from special blanks, which cannot be processed on normal packaging machines. These packets are therefore difficult to make, because they need special production lines that have a high cost and considerable bulk.

A packet of this type is also described in WO-A-2007/144043, where the external containing body of the external shell is provided with an aperture, made in a lower portion of a front wall and in a central portion of its base wall, so as to allow access to the internal shell, in particular to a base side thereof. Furthermore, in the packet described in WO-A-2007/144043, the lid is connected to the internal shell by a tongue protruding from a front side, facing the front wall of the external containing body of the internal shell. In use, a consumer inserts a finger into said aperture and, acting on the base side, thrusts the internal shell toward the outside of the containing body. Following this relative movement, the tongue, connected to the lid, rotates the latter to an open position. After extracting the cigarette, in order to reclose the packet, the consumer thrusts the internal shell toward the inside of the containing body until the base side abuts on the base wall. Following this relative movement, the tongue, connected to the lid, rotates the latter to a closed position. One defect of packets of the type described in WO-A-2007/144043 is the small space available to personalize the packets, for example using writings, drawings or more generally promotional messages printed on the visible surfaces of the packet. In fact, such messages can be printed as well as on the external containing body, as already happens in traditional packets, only on a limited end portion of one rear side, opposite said front side, of the internal shell, protruding, in an open configuration of the packet, from the containing body. However, the transverse length of the tongue, connecting the internal shell to the lid, greatly limits the end portion of the rear side visible in the open configuration of the packet.

In these known solutions, the packet cannot be used in a traditional way, since the consumer has to use his finger to thrust the internal shell, as discussed above.

Furthermore, in these known solutions and in similar solutions where the internal shell can be made to slide and partly extracted from the external containing body, it is necessary to provide mechanical stops to prevent the accidental complete exit of the internal shell, which entails further working, modifications to traditional machines and hence an increase in terms of times and costs.

Another known packet is described for example in CN-A-2483353, which provides an internal shell that slides to be extracted from an external containing body, by pressure from below through an aperture made on a base wall of the external containing body. This packet cannot be made on traditional packaging machines either.

It should also be noted that, although packets with a slide-open internal container are appreciated by young or imaginative smokers, more conservative smokers have shown a certain aversion for this type of packet and for the complicated opening systems that they entail.

In this context, document WO-A-2013/068959 is also known, which provides a hinged-lid slide-open packet similar to those described above, in which the internal shell, to which the closing lid is hinged and of which it is part, partly slides outside the external containing body between the closed configuration and the open configuration. Thanks to a tongue of the internal shell that connects the lid to the external containing body as well, this allows to "automatically" rotate the lid when the internal shell slides with respect to the external containing body. In this solution too, the base wall of the external containing body has an aperture through which the consumer can exert a thrust on the internal shell so as to slide it and partly remove it. In this known solution, moreover, the closing lid is configured to be included completely retracted in the external containing body when the packet is in the closed configuration, and is thus completely hidden, flush with the upper edges of the external containing body. This solution is even further from the characteristics and exterior appearance typical of a traditional cigarette packet, and therefore can represent a solution that does not please all smokers, in particular more conservative ones. Furthermore, this configuration of the closing lid requires using a specific blank, which on the one hand is in itself an additional cost, and on the other hand makes the blank and the packet impossible to process on the packaging machines that are normally available to cigarette producers. Moreover, this known packet can suffer from poor resistance and rigidity of the internal shell, in particular when, during use, the number of smoking articles contained therein diminishes.

Furthermore, other known packets are described for example in WO-A-2009/125240 and WO-A-2011/058414, in which the closing lid is part of the external containing body, but can be separated from it to allow the sliding extraction of the internal shell. When this happens, since it is also constrained to the internal container, the closing lid is translated together with the latter. In this context, document WO-A-2011/092567 is also known, in which the closing lid is separated from the internal shell and is integrated with the external containing body, remaining thus even when the internal shell is slidingly removed.

Other known packets are described in GB-A-568.649, DE-A-1.285.948 and U.S. Pat. No. 1,902,963.

As we said, it is a strongly felt requirement in this field to provide packets that satisfy all the needs described above, and that can be processed on normal packaging machines, without having to use different or special machines or production lines, or in any case providing only minimum adjustments or implementations to traditional known machines. Indeed it is obvious that, for producers, the choice of producing packets that entail purchasing new and dedicated packaging machines constitutes an increase in costs to be sustained.

There is therefore a need to perfect a packet for smoking articles that can overcome at least one of the disadvantages of the state of the art.

In particular, one purpose of the present invention is to improve packets for smoking articles, in particular cigarettes, and the blanks that can be used to obtain such packets.

Another purpose is to provide rigid packets for smoking articles, in particular but not exclusively cigarettes, that have a large surface available for communications to the consumer, advertising messages and suchlike.

Another purpose is to provide packets for smoking articles, in particular cigarettes, that can be produced easily even on traditional packaging machines.

Another purpose is to provide packets for smoking articles, in particular cigarettes, that are versatile, so that they can be appreciated both by smokers with conservative tastes and also by smokers that enjoy innovative configurations.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

Forms of embodiment described here concern a packet for smoking articles that overcomes the limits of the state of the art and eliminates the defects present therein, and that includes an external shell and an internal shell to contain smoking articles.

In accordance with the present description, the external shell comprises an external containing body, a closing lid hinged to the internal shell and a connection tongue, configured to connect the closing lid to the external containing body.

Moreover, in accordance with the present description, the internal shell is configured to slide, with respect to the external containing body, between a closed condition, where the internal shell is inserted inside the external shell, and an open and extraction configuration, where the internal shell is partly extracted from the external containing body.

Other embodiments refer to a packet for smoking articles comprising:

an external shell with an access aperture, an internal shell to contain smoking articles provided with a rear wall comprising one or more upper folding flaps delimited by a folding line, wherein the external shell comprises:

an external containing body, a closing lid hinged to the internal shell by means of a hinge defined by said folding line and able to position itself between an open condition, in which it allows access to the smoking articles contained in the internal shell, and a closed condition, in which it closes said access aperture of the external shell, said closing lid being provided with a rear wall, a connection tongue configured to connect the closing lid to the external containing body, said connection tongue being part of said rear wall of the closing lid and being delimited laterally by two incisions, or notches which define one or more smaller lateral panels of the rear wall of the closing lid, said one or more smaller lateral panels being attached to said one or more upper folding flaps and rotatable around said folding line which said hinge defines, wherein the internal shell is configured to slide, with respect to the external containing body, between a closed configuration where the internal shell is completely inserted inside the external shell and where the closing lid is, in the closed condition, completely outside both the internal shell and the external containing body, and an open and extracted configuration where the internal shell is partly extracted from the external containing body, wherein, moreover, the external containing body, the closing lid and the connection tongue which form the external shell have no other functional apertures to put said internal shell in said open and extracted configuration.

Other forms of embodiment concern a single blank to make a packet for smoking articles according to the present description. The blank comprises, in a single body, a first portion intended to form an external containing body of said packet, and a second portion, intended to form a closing lid. The second portion comprises a transverse panel intended to form a rear wall of the closing lid, which is provided with two notches, or incisions, that create a central panel intended to form a connection tongue to connect the closing lid to the external containing body and one or more lateral panels intended to form one or more smaller lateral panels of the rear wall of the closing lid in order to attach the closing lid to the internal shell. According to the present invention, the first portion and the second portion are joined only by means of the central panel.

These and other aspects, characteristics and advantages of the present disclosure will be better understood with reference to the following description, drawings and attached claims. The drawings, which are integrated and form part of the present description, show some forms of embodiment of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of forms of embodiment, given as a non-restrictive example with reference to the attached drawings wherein.

Figure 2:
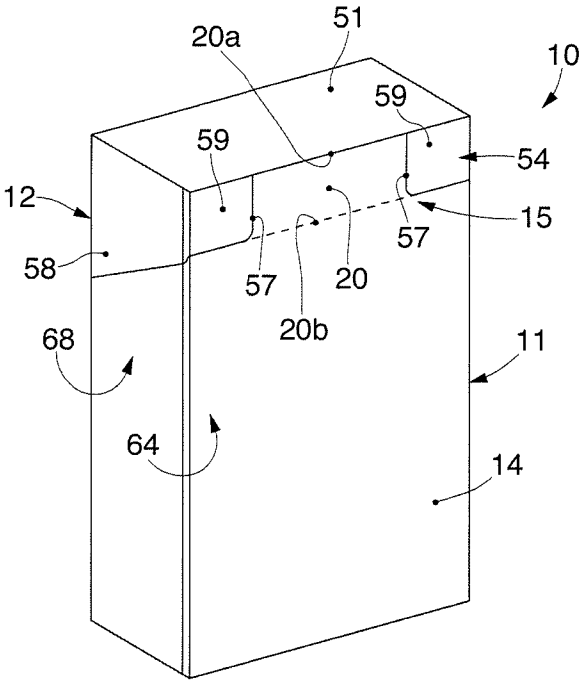
FIG. 2 is a rear perspective view of a packet in accordance with forms of embodiment described here, in a closed condition.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF FORMS OF EMBODIMENT

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

FIGS. 1-11, 15*a*-15*d*, 16*a*-16*c*, 17*a*-17*c* are used to describe forms of embodiment of a packet 10 for smoking articles, for example cigarettes, cigars or similar or equivalent, of the type with a hinged lid and sliding aperture ("hinged-lid, slide-open" packet).

In possible implementations, the packet 10 can have a rectangular parallelepiped shape, that extends along a longitudinal axis X. The edges of the packet 10 can be squared, or rounded or beveled.

Figure 9:
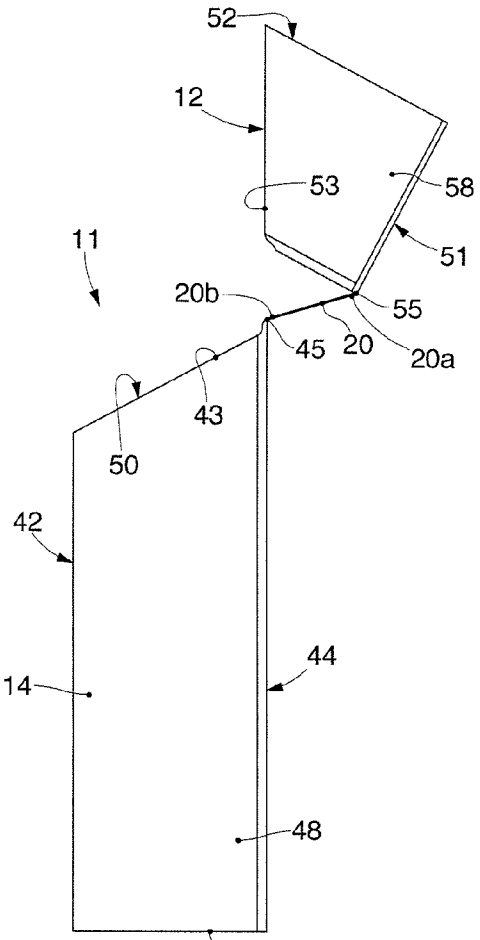
FIG. 9 is a lateral view of an external shell for a packet in accordance with the present description.
Figure 8:
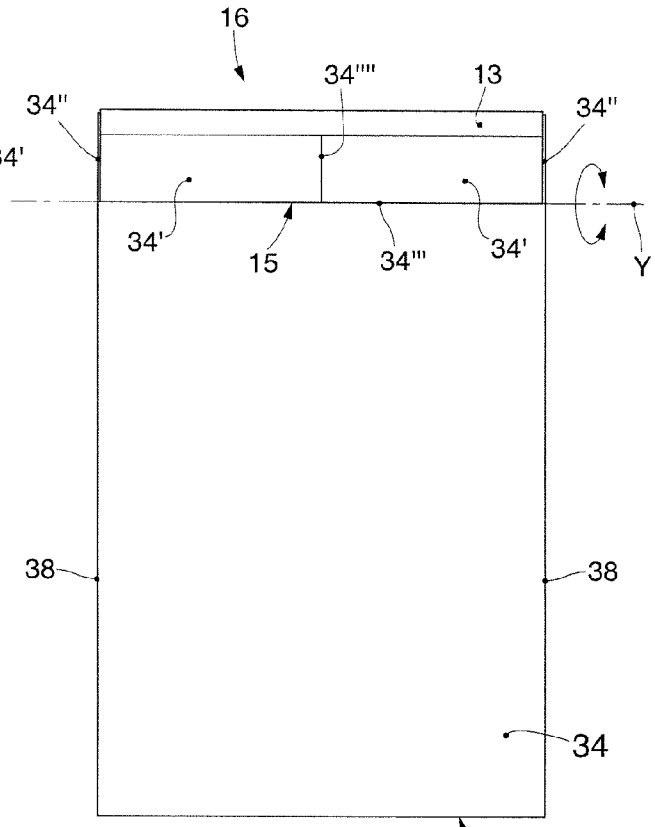
FIG. 8 is a view from the rear of an internal shell for a packet in accordance with the present description.
Figure 7:
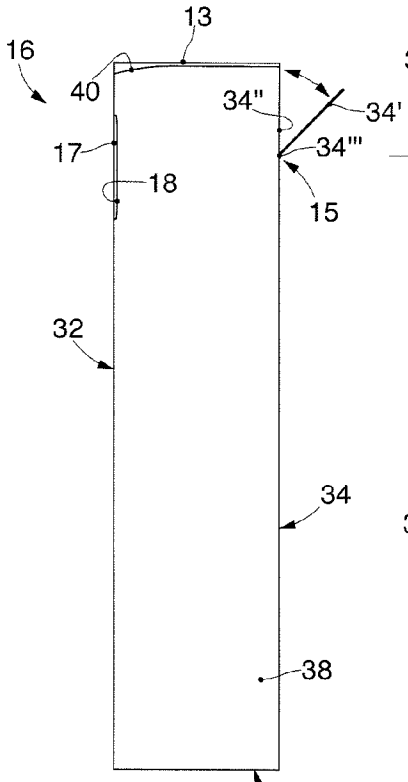
FIG. 7 is a lateral view of an internal shell for a packet in accordance with the present description.

In accordance with the present description, the packet 10 is a rigid packet which includes an internal shell 16 (see FIGS. 7 and 8 for example) and an external shell 11 (see FIG. 9 for example).

Figure 3:
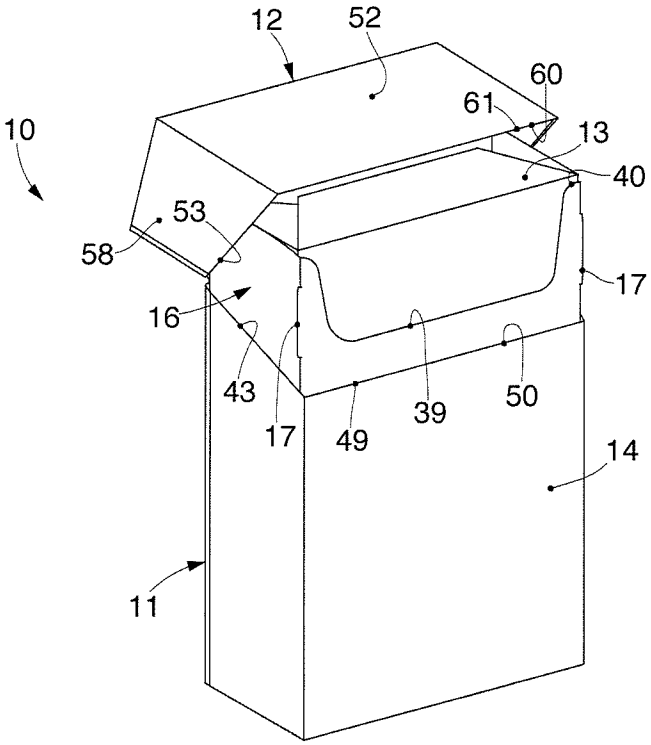
FIG. 3 is a front perspective view of a packet in accordance with forms of embodiment described here, in an open condition.
Figure 18A:
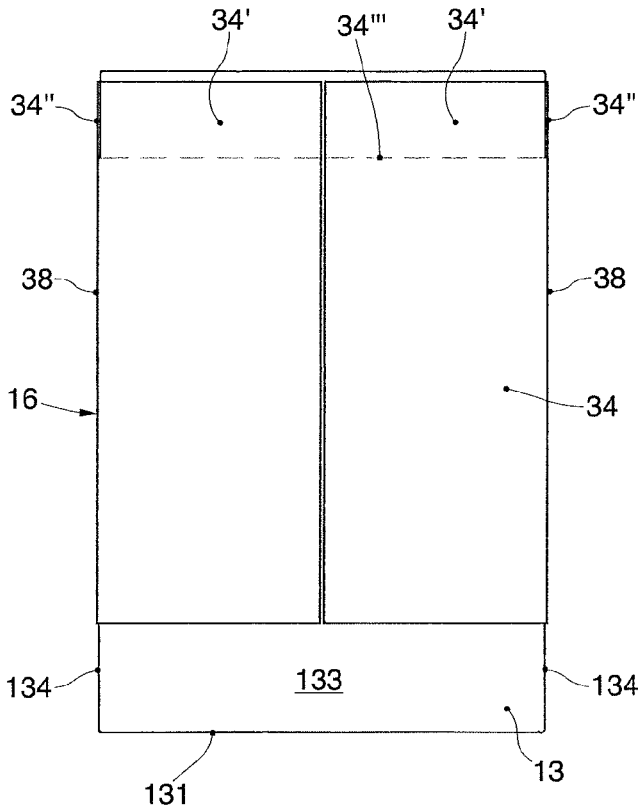
FIGS. 18*a* and 18*b* show a rear and lateral view respectively of an internal shell that encloses a wrapper, which will be housed inside a packer according to forms of embodiment described here.
Figure 18B:
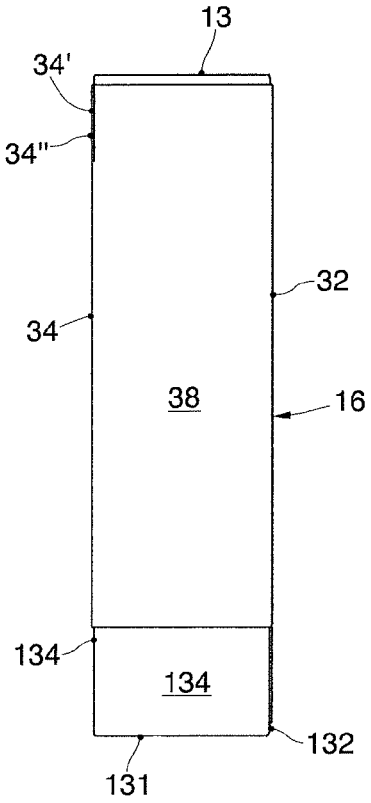

Typically the internal shell 16 can contain a group of organized smoking articles, generally wrapped in a wrapper 13 (see FIGS. 3, 18*a*, 18*b* for example). The wrapper 13 is able to house the group of organized smoking articles and is conformed to be inserted inside the external shell 11.

The external shell 11 is provided with an access aperture, which is typically delimited by a peripheral edge, or aperture edge. It is possible to access the smoking articles contained in the internal shell 16 through this aperture.

The internal shell 16 can be a collar, in particular a rigid collar. The collar can surround the wrapper 13. In particular, as is clear, the collar can surround the wrapper 13, wrapping it closely, so as to render the collar integral with the wrapper 13. Typically the wrapper 13 can be integrated with the internal shell 16, using adhesive or glue for example. For example, the union between the collar and the wrapper 13 can be obtained using a common adhesive located between the contact walls respectively of the collar and the internal wrapper. In possible implementations, the collar can be open at the top and bottom and can enclose on three sides or on four sides the group of organized smoking articles, wrapped in the wrapper 13. Furthermore, the collar can be open at the top and closed at the bottom and can therefore enclose on five sides the group of organized smoking articles, wrapped in the wrapper 13.

In accordance with the present description, the external shell 11 includes an external containing body 14. The external containing body 14 has said access aperture delimited by a peripheral edge. Moreover, in accordance with the present description, the external shell 11 includes a closing lid 12 and a connection tongue 20, configured to connect the closing lid 12 to the external containing body 14. In particular, the connection tongue 20 can be provided with a proximal connection end 20*a* connected to the closing lid 12. For example, the proximal connection end 20*a* can be connected to an edge of the closing lid 12. Moreover, the connection tongue 20 can be provided with a distal connection end 20*b* connected to the external connection body 14, in particular to said peripheral edge that delimits the access aperture of the external shell 11 (see FIGS. 2, 6, 9, 10, 11, 13, 15*c*, 15*d*, 16*c*, 17*b*, 17*c* for example).

Figure 6:
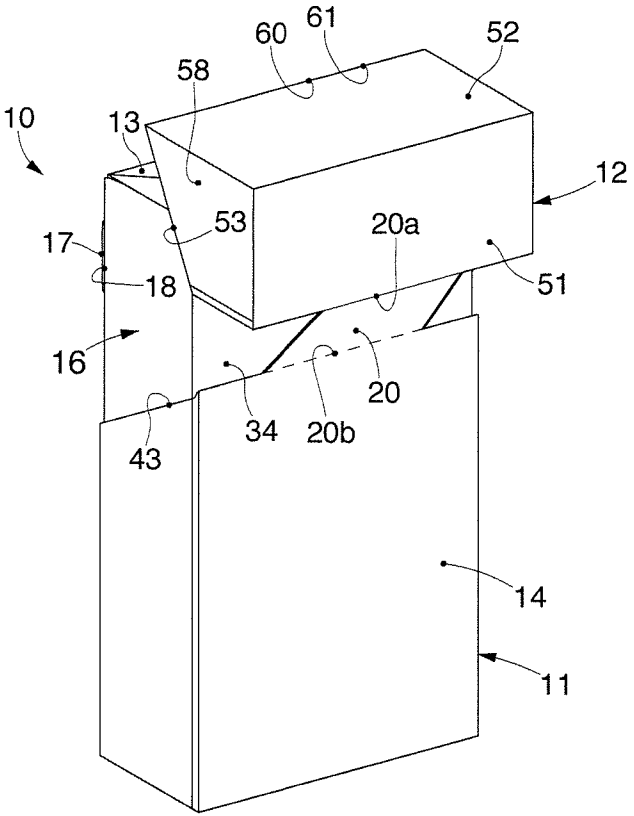
FIG. 6 is a rear perspective view of a packet in accordance with forms of embodiment described here, in an open and extracted condition.
Figure 11:
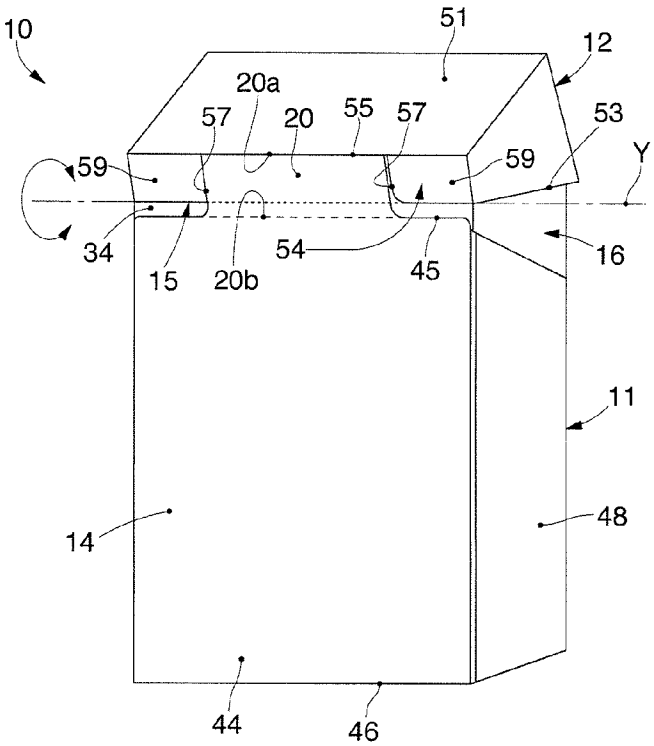
FIG. 11 is a perspective rear view of a packet according to forms of embodiment described here, in an open and partly extracted condition.
Figure 10:
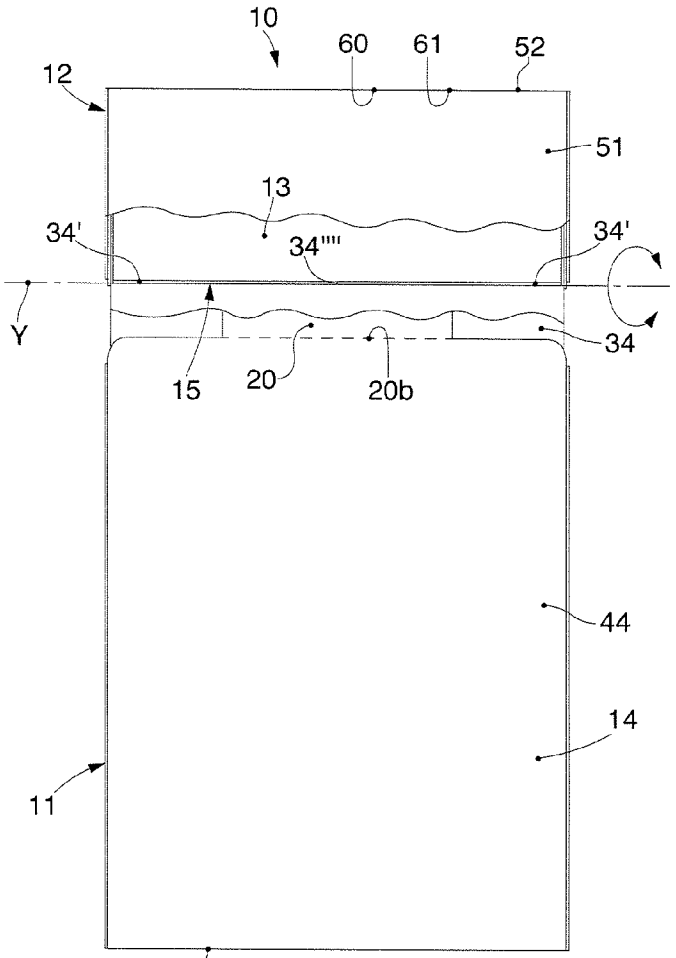
FIG. 10 is a partly sectioned rear view of a packet according to forms of embodiment described here, in an open and partly extracted condition.
Figure 12:
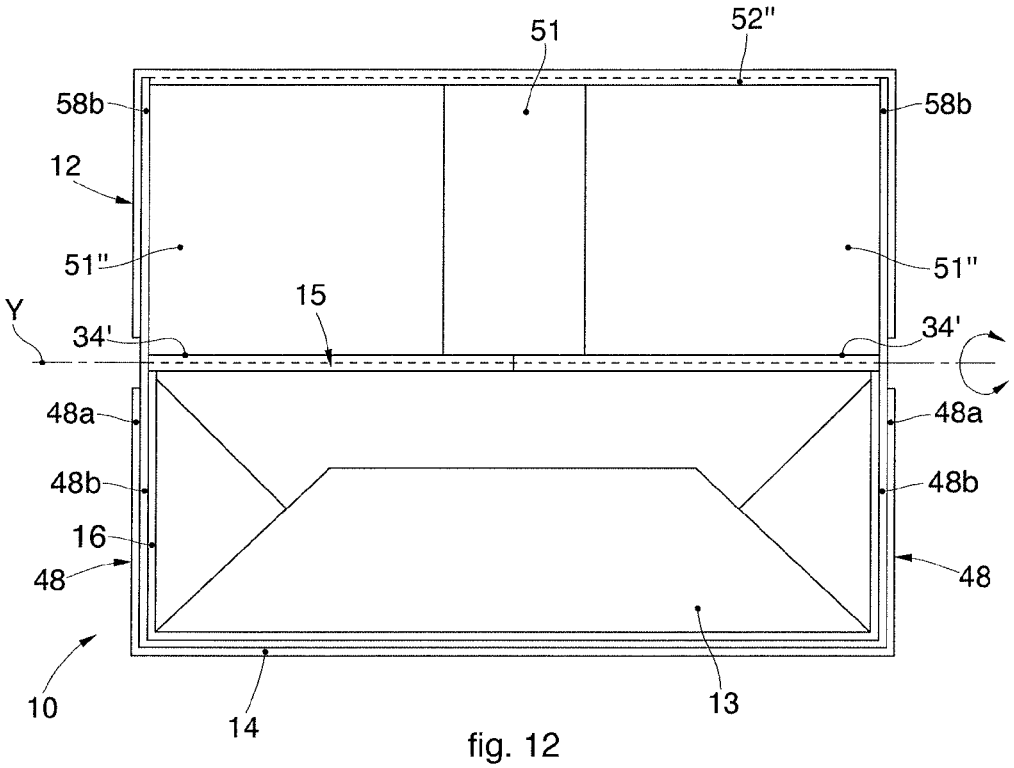
FIG. 12 is a plan view from above of a packet according to forms of embodiment described here, in an open condition.
Figure 13:
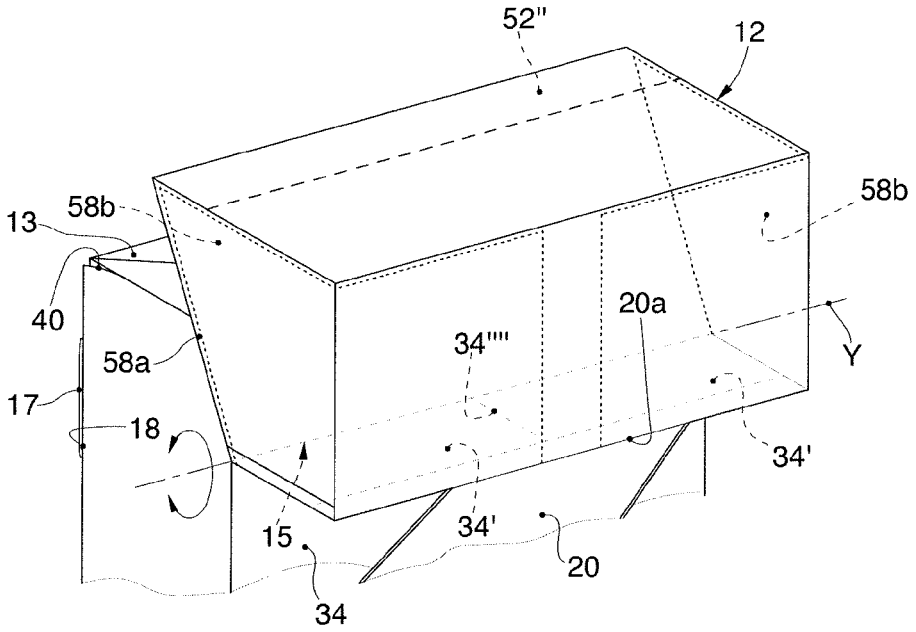
FIG. 13 is a perspective rear view of part of a packet according to forms of embodiment described here, in an open and extracted condition.

In possible implementations, the closing lid 12 is connected to the external closing body 14 by means of the connection tongue 20, that can be configured to define a double-jointed articulated connection of the closing lid 12 to the external connection body 14, see FIGS. 6, 9 and 11 for example.

The closing lid 12 is hinged to the internal shell 16, and is thus able to rotate around a hinge or hinging line 15 (see FIGS. 2, 7, 8, 10, 11, 12, 13, 15*a*, 15*c*, 15*d*, 16*c* for example). The hinge or hinging line 15 can be provided on the internal shell 16.

In particular, the hinge 15 by means of which the closing lid 12 is hinged to the internal shell 16 defines a lid hinging axis Y around which the closing lid 12 can rotate.

This rotatable configuration around the hinge 15 allows to rotate the closing lid 12 between a closed condition (see FIGS. 1 and 2 for example) and an open condition (see FIGS. 3, 4, 15*a*-15*d*, 17*b* for example), in order to respectively close the access aperture and prevent access to the smoking articles contained in the internal shell 16 or to allow access to the smoking articles. In the closed condition, the closing lid 12 can typically abut against the peripheral edge that delimits the access aperture of the external shell 11, in particular of the external containing body 14. Moreover, in the closed condition of the closing lid 12, the internal shell 16 together with the wrapper 13 are housed completely inside the external shell 11.

Figure 14:
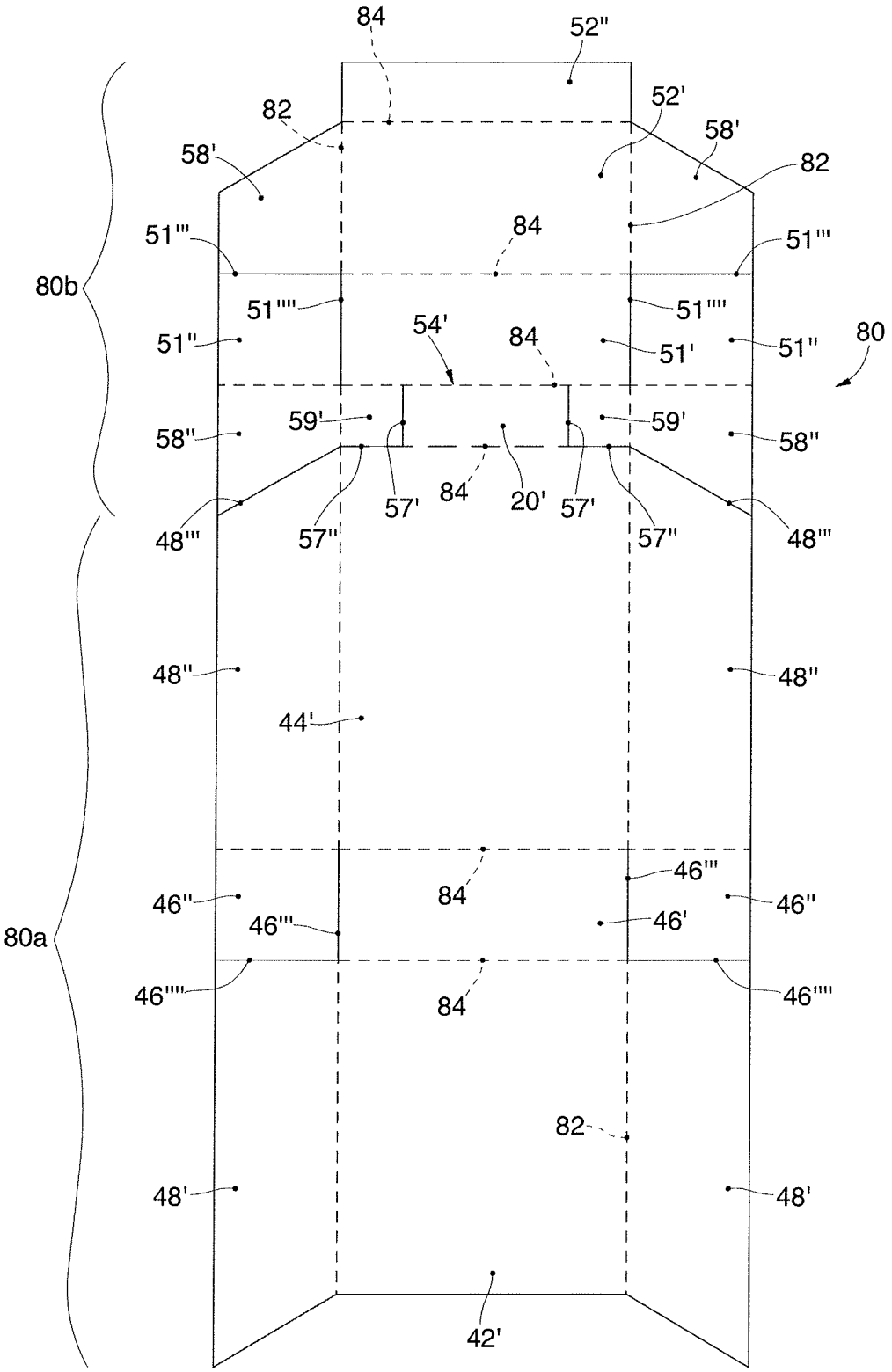
FIG. 14 is a plan view from above of a blank, in accordance with the present description.
Figure 20:
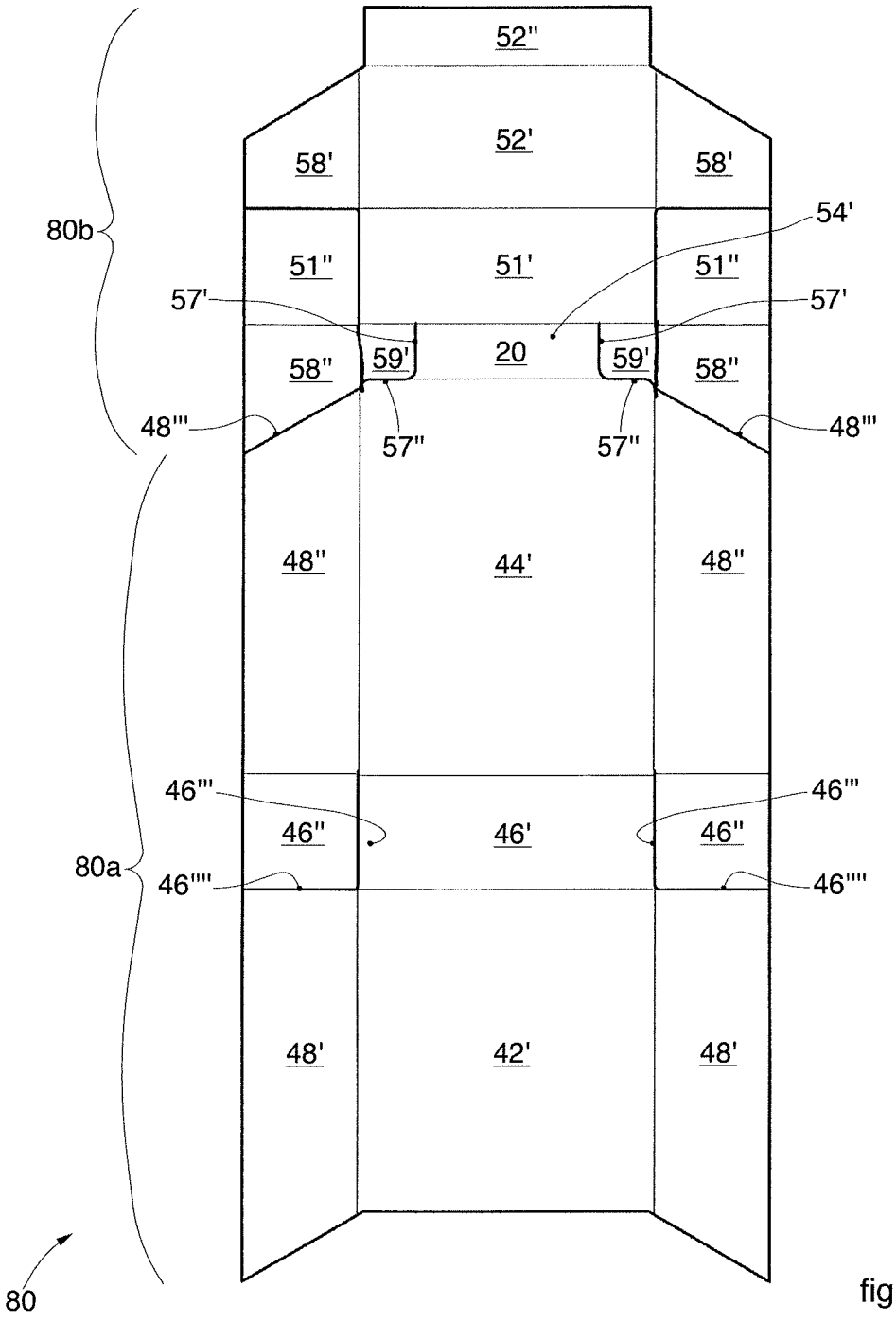
FIG. 20 shows a blank of an external shell for a packet according to forms of embodiment described here.

In accordance with possible forms of embodiment described here, the external containing body 14, the closing lid 12 and the connection tongue 20 that form the external shell 11 can constitute a single body in continuous material from which they are made, and are therefore obtained from a single blank 80, suitably shaped and folded, as explained in detail hereafter (see FIGS. 14 and 20 for example).

Moreover, in accordance with the present description, the internal shell 16 is configured to slide, with respect to the external containing body 14, between a closed configuration (see FIGS. 1 and 2 for example), in which the internal shell 16 is completely inserted inside the external shell 11, and an open and extracted configuration (see FIGS. 5, 6, 15*a*-15*d*, 17*a*-17*c* for example), in which the internal shell 16 is partly extracted from the external shell 11, in particular from the external containing body 14. In other words, the packet 10 that includes the internal shell 16 that slides with respect to the external shell 11 is the "slide-open" type.

Moreover, the fact that the closing lid 12 is connected to the internal shell 16 by the hinge 15, as described above, prevents the internal shell 16 from being accidentally extracted completely from the external shell 11, in particular from the external containing body 14. Consequently, in possible implementations, the hinge 15 acts as a stopping or holding element to prevent the internal shell 16 from exiting completely from the external shell 11. In this way, it is not necessary to provide additional stopping and holding elements, thus avoiding further work that would increase times, complexity and costs of production.

In some forms of embodiment, the hinge or hinging line 15 can be in correspondence to the distal connection end 20*b* of the connection tongue 20 when the closing lid 12 is in its closed condition (see FIG. 2 for example).

Figure 15A:
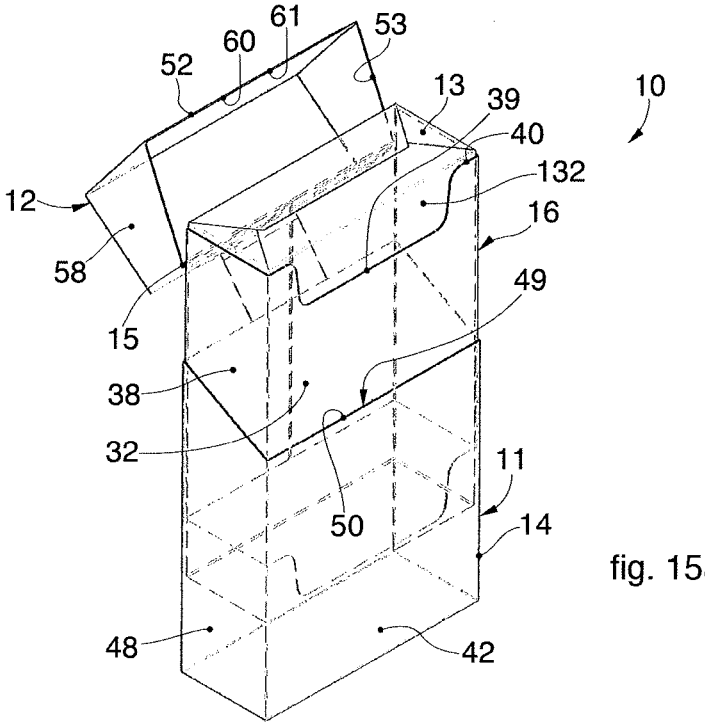
FIGS. 15*a* to 15*d* show different perspective views of a packet for smoking articles with the lid open, according to forms of embodiment described here.
Figure 15B:
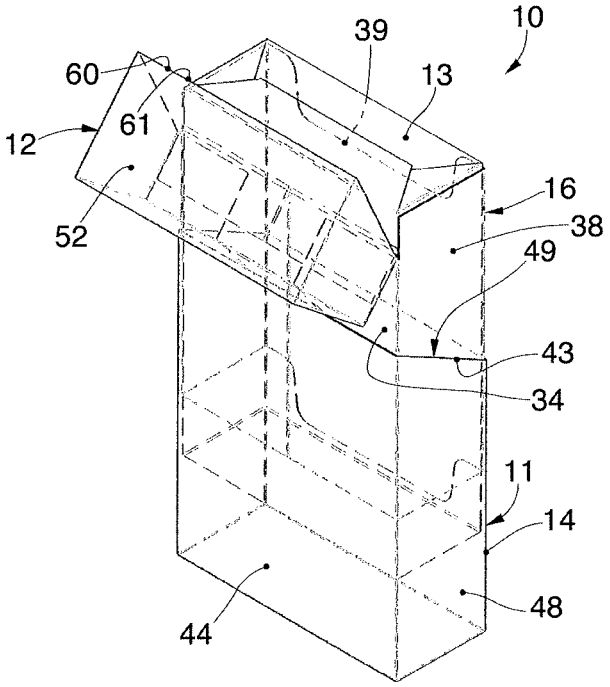
Figure 15C:
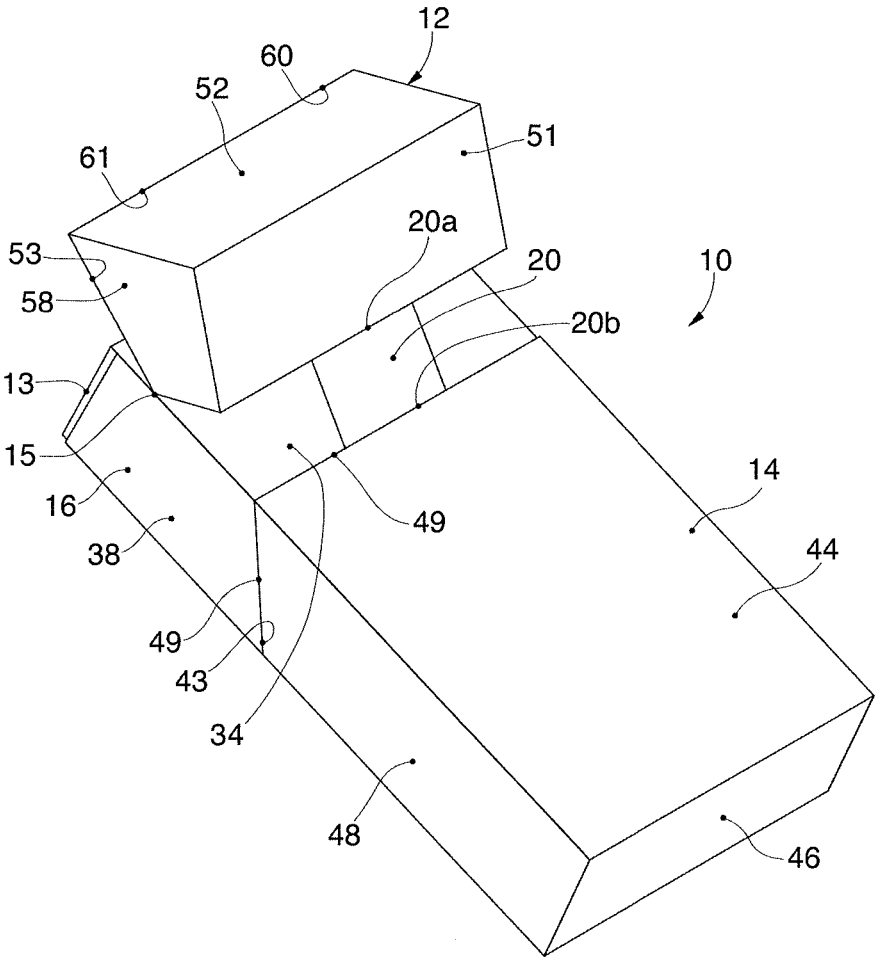
Figure 15D:
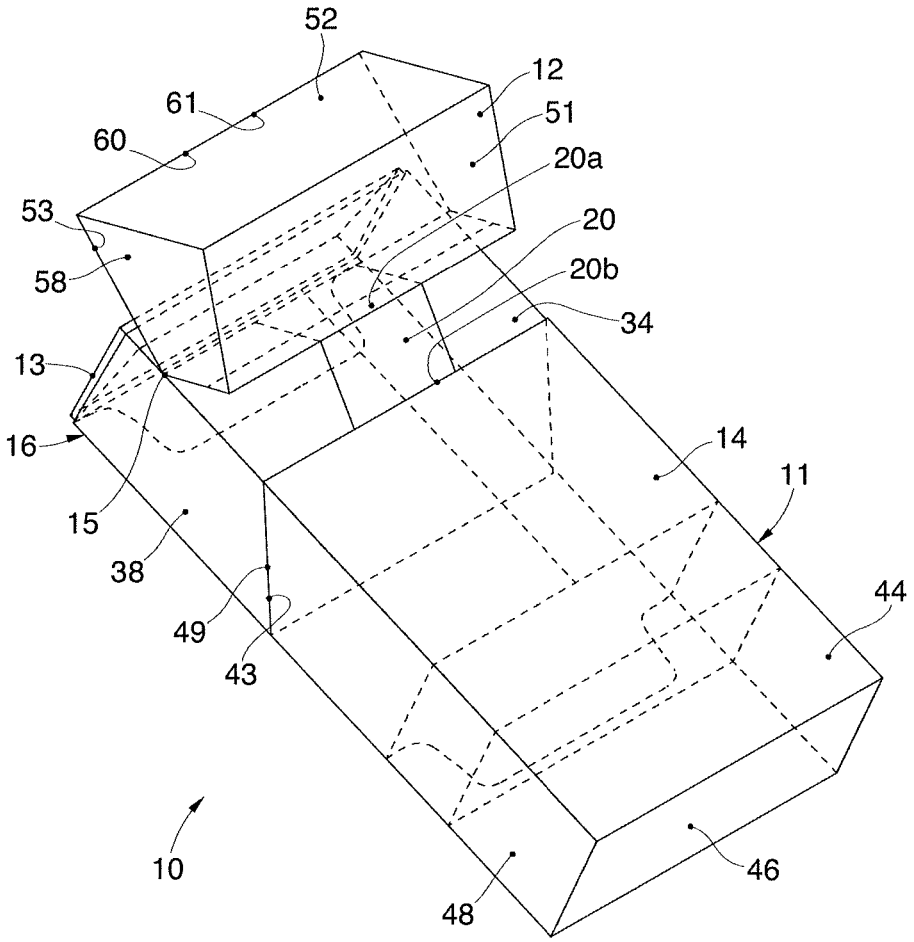
Figure 16A:
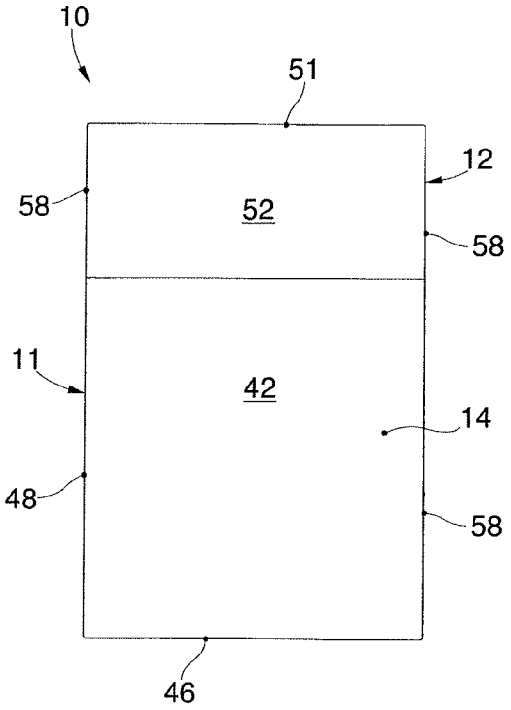
FIGS. 16*a*-16*c* show different views of a packet according to forms of embodiment described here with the lid closed.
Figure 16B:
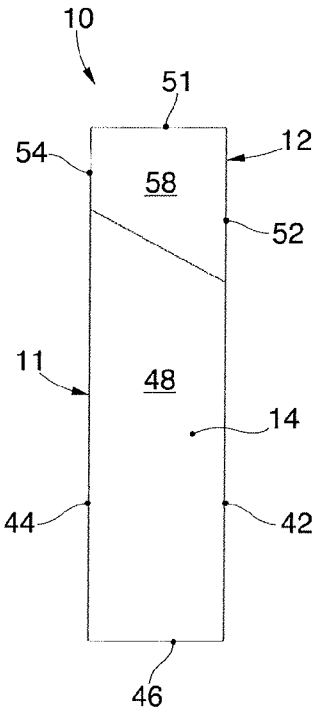
Figure 16C:
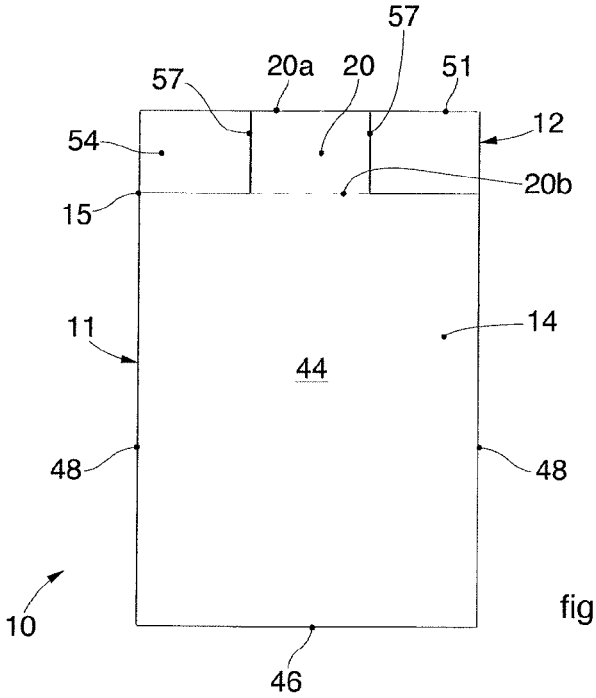
Figure 17A:
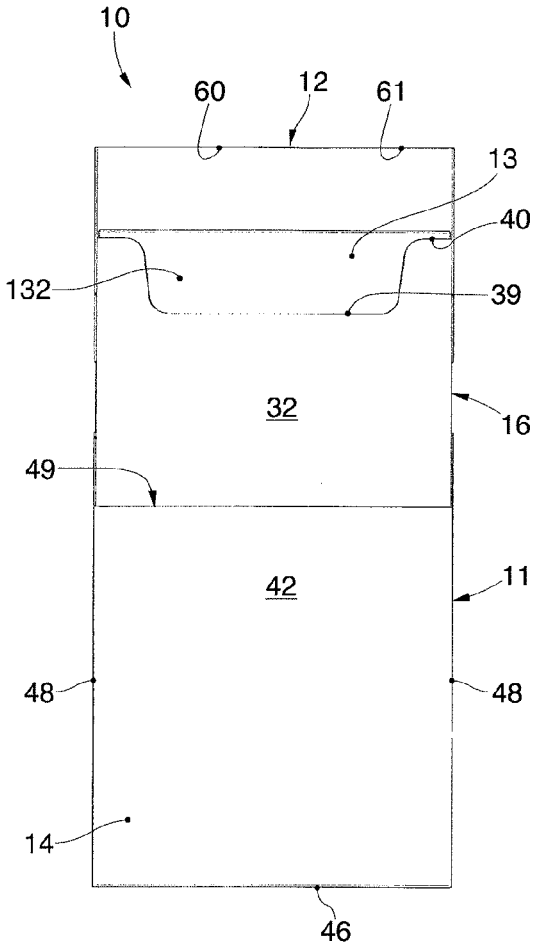
FIGS. 17*a*-17*c* show different views of a packet according to forms of embodiment described here with the lid open.
Figure 17B:
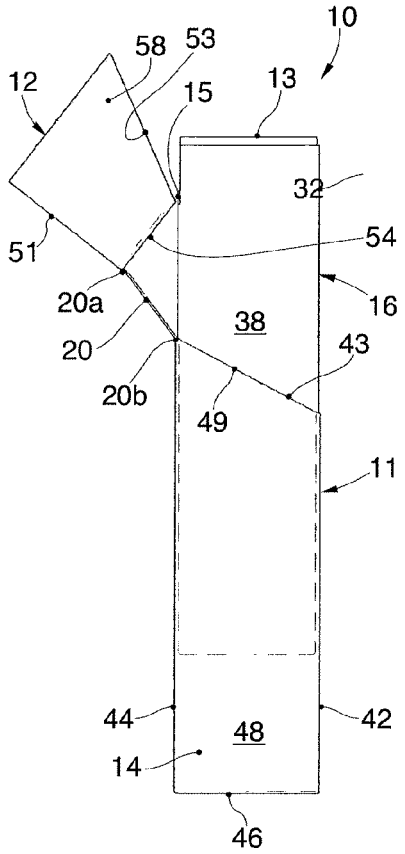
Figure 17C:
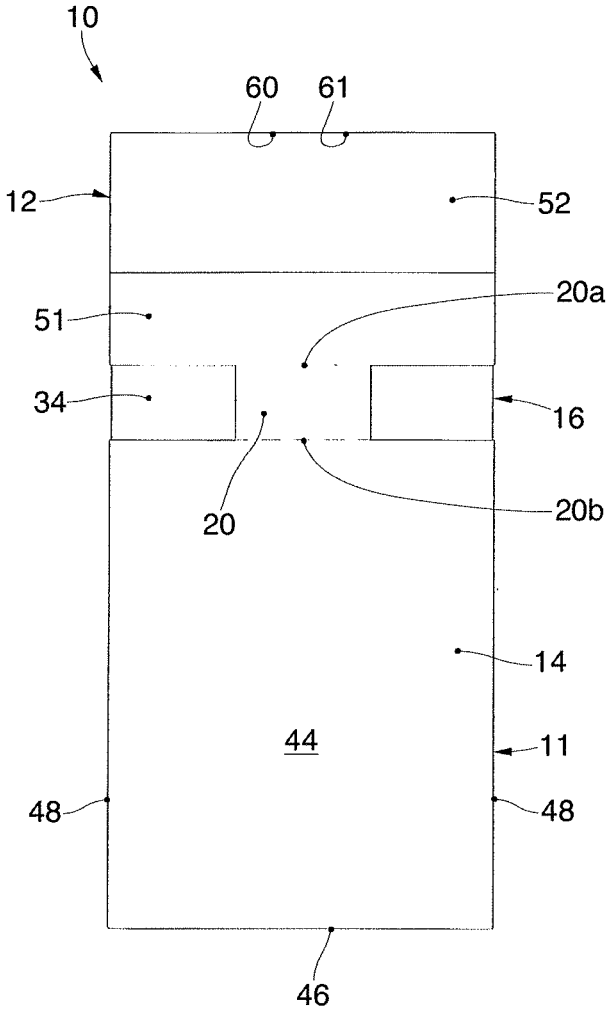

Moreover, in some forms of embodiment, the hinge or hinging line 15 can surpass the proximal connection end 20*a* of the connection tongue 20, thus distancing itself from the distal connection end 20*b* of the connection tongue 20, when the closing lid 12 is in its open condition (see FIGS. 15*c*, 15*d* for example).

Advantageously, therefore, the wrapper 13 together with the internal shell 16 can be driven slidingly inside the external containing body 14 operating directly on the closing lid 12. Functional apertures are thus not needed on the external shell 11, in particular on the external containing body 14, or on the closing lid 12 or on the connection tongue 20, in order to actuate this sliding extraction movement.

In practice, when the user opens the closing lid 12 in order to access the group of smoking articles, with a simple pulling operation he/she can also lift the internal shell 16, to which the closing lid 12 is hinged, together with the wrapper 13, so as to make visible the external walls of the internal shell 16 that protrude with respect to the peripheral edge that defines the access aperture of the external shell 11. The presence of the connection tongue 20 is functional to prevent the wrapper 13, wrapped by the internal shell 16, from exiting completely from the external containing body 14. In other words, the connection tongue 20 has an end-of-travel function for the sliding of the wrapper 13 wrapped by the internal shell 16 with respect to the external containing body 14. In this way the separation of the wrapper 13 wrapped by the internal shell 16 and the external containing body 14 is prevented.

Therefore, in accordance with the present description, the external shell 11, and in particular the external containing body 14, the closing lid 12 and the connection tongue 20 that form the external shell 11, has no other functional apertures, fissures, windows or other similar passages which can be used by a consumer to push the internal shell 16 to extract it from the external shell 11; that is, they have no other functional apertures able to put the internal shell 16 in the open and extracted configuration. Indeed, to this purpose, as we said, it is enough to operate a traction on the closing lid 12, that is always located outside the packet 10 and therefore easily accessible, rotating it around the hinge 15, which closing lid 12 therefore pulls with it, to the outside, the internal shell 16 to which it is connected, extracting it as desired.

In this way, in particular in the closed configuration (FIGS. 1 and 2) or in the configuration where the closing lid 12 is open but the internal shell 16 is not extracted (FIGS. 3 and 4), the external shell 11 has an aesthetic conformation which is totally traditional and acceptable even to conservative smokers, but at the same time it can be converted into a more modern and original packet, and therefore used with satisfaction even by innovative smokers, thanks to its "slide-open" configuration.

In accordance with forms of embodiment described here using FIGS. 18*a* and 18*b*, and combinable with all the forms of embodiment described here, the wrapper 13 that wraps the group of smoking articles can comprise a base wall 131, from which a front wall 132 and a rear wall 133, opposite the front wall 132, develop. Between the front wall 132 and the rear wall 133 two lateral walls 134 are interposed, which join the front wall 132 and the rear wall 133.

In accordance with possible forms of embodiment, described using FIGS. 7, 8, 17*a*, 17*b*, 18*a*, 18*b* for example, and combinable with all the forms of embodiment described here, the internal shell 16 can be a parallelepiped shape with a rectangular cross section, shaped as a cup for example, and can include a front wall 32, a rear wall 34, two parallel lateral walls 38 and can have at the upper part an opening upper end 40. The internal shell 16 can be open at the lower part, or be closed and therefore have a base wall 36. If the internal shell 16 has a base wall 36, this can therefore be conformed as a cup.

Therefore, with regard to with the internal shell 16, four longitudinal edges can be defined between the front wall 32, rear wall 34, and lateral walls 38, and four lower transverse edges between front wall 32, rear wall 34, lateral walls 38 and the base wall 36.

In possible implementations, the internal shell 16 can also have a removal window 39 (see FIGS. 3 and 5 for example) through which the smoking articles are removed. The removal window 39 can facilitate, for example, at least initially, the removal of the smoking articles by the consumer. The removal window 39 can be provided as a shaped aperture, of an essentially concave shape, typically with an open profile, in the upper part of the front wall 32. The removal window 39 can be defined, for example, by an upper cut on the internal shell 16, to facilitate access to the smoking articles contained in the wrapper 13. The upper cut can be U-shaped and protrude from the peripheral edge of the access aperture of the external containing body 14 even when the internal shell 16 together with the wrapper 13 are entirely housed in the external containing body 14. By the expression "entirely housed" we mean when the closing lid 12 is in the closed condition and generally the base wall 131 of the wrapper 13, enclosed by the internal shell 16, contacts a base wall 46 of the external containing body 14, or the base wall 36 of the internal shell 16, if provided, contacts the base wall 46 of the external containing body 14.

In accordance with possible forms of embodiment described using FIG. 9 for example, and combinable with all the forms of embodiment described here, the external containing body 14 can be essentially of a parallelepiped shape with rectangular cross section, shaped like a cup for example, and can include a front wall 42, a rear wall 44, said base wall 46, two parallel lateral walls 48. The front wall 42 can have a smaller extension than the rear wall 44. The distal connection end 20*b* of the connection tongue 20 can be attached to the rear wall 44 of the external containing body 14. Moreover the connection tongue 20 can be positioned essentially centrally between the lateral walls 48 of the external containing body 14. The external containing body 14 can also have an opening upper end 50, in this case delimited by a peripheral edge 49 (see FIGS. 3 and 5 for example). The opening upper end 50 delimited by the peripheral edge 49 defines the access aperture of the external shell 11. In the closed condition, the closing lid 12 can therefore abut against the peripheral edge 49 of the external containing body 14. Moreover, the base wall 46 of the external containing body 14 defines a base wall of the external shell 11.

Therefore, with regard to the external containing body 14, four longitudinal edges can be defined between front wall 42, rear wall 44 and lateral walls 48, and four lower transverse edges between front wall 42, rear wall 44, lateral walls 48 and base wall 46.

In accordance with possible forms of embodiment, with reference to FIG. 9 for example, the closing lid 12 can be cup shaped, and can include an upper wall 51, that in the closed condition is parallel to the base wall 46 of the external containing body 14, a front wall 52, a rear wall 54, connected to the rear wall 34 of the internal shell 16, two parallel lateral walls 58, and an opening lower end 60, that can be delimited by a peripheral edge 61. The upper wall 51 of the closing lid 12 defines an upper wall of the external shell 11. The front wall 52 of the closing lid 12 can have a longer extension than the rear wall 54 of the closing lid 12. The longer extension can be equal to the difference between the extension of the rear wall 44 of the external containing body 14 and the front wall 42 of the external containing body 14. Moreover, it can be provided that the proximal connection end 20*a* of the connection tongue 20 is attached to an edge that divides the upper wall 51 of the closing lid 12 from the rear wall 54 of the closing lid 12.

In particular the closing lid 12 can be a box-like lid, that is, it can include walls 52, 58, 54 that are perpendicular one consecutively to the other, that is, wall 52 is orthogonal to wall 58, which in its turn is orthogonal to wall 54, consequently parallel to wall 52, so as to give a box-like shape to the closing lid 12.

Figure 1:
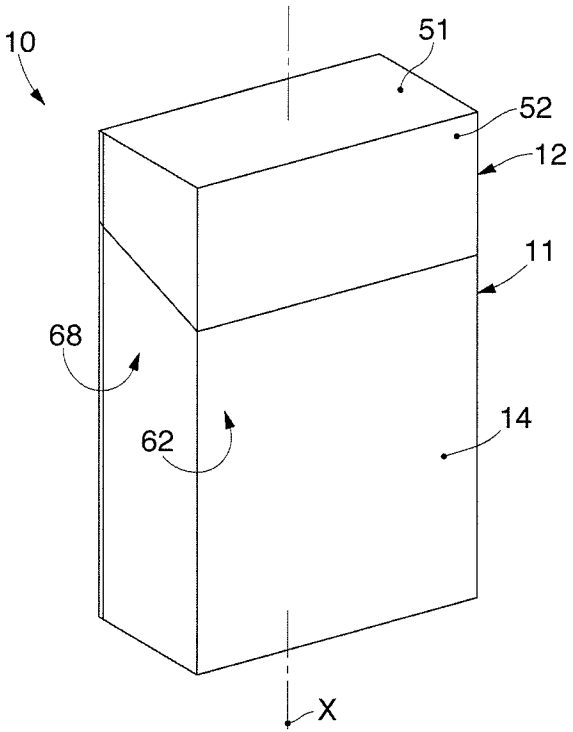
FIG. 1 is a front perspective view of a packet in accordance with forms of embodiment described here, in a closed condition.
Figure 4:
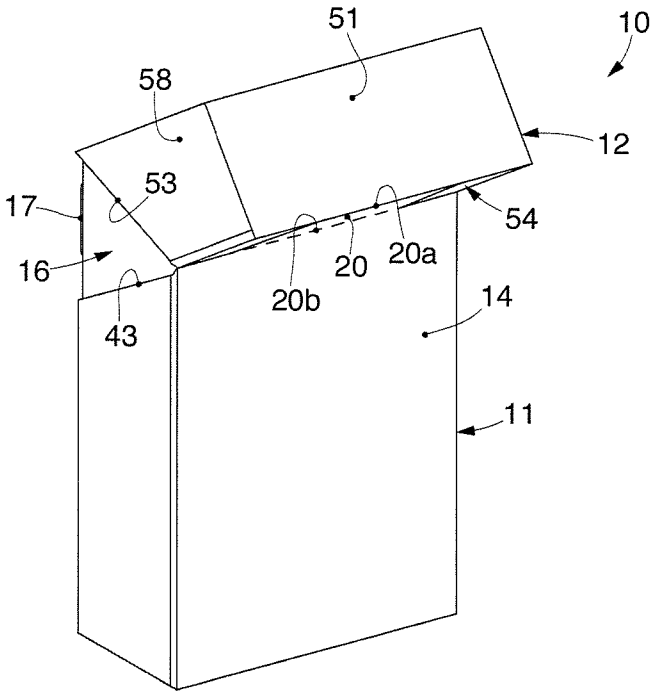
FIG. 4 is a rear perspective view of a packet in accordance with forms of embodiment described here, in an open condition.

According to forms of embodiment described here, the front wall 42 of the external containing body 14 and the front wall 52 of the closing lid 12 form overall a front wall 62 of the external shell 11 (see FIG. 1 for example).

In accordance with the present description, and with reference to the front wall 42 and the front wall 62, by the term "front" we mean the side from which normally the smoking articles are extracted by the consumer, for example through the removal window 39, and therefore opposite the side toward which the closing lid 12 rotates when it is opened.

According to forms of embodiment described here, the rear wall 44 of the external containing body 14 and the rear wall 54 of the closing lid 12 form overall a rear wall 64 of the external shell 11 (see FIG. 2 for example).

According to other forms of embodiment described here, the lateral walls 48 of the external containing body 14 and the lateral walls 58 of the closing lid 12 can be at least double, that is, each comprising an external portion and an internal portion, as also described hereafter.

According to other forms of embodiment described here, the lateral walls 48 of the external containing body 14 and the lateral walls 58 of the closing lid 12 form overall lateral walls 68 of the external shell 11 (see FIGS. 1 and 2 for example).

In particular, the lateral walls 48 of the external containing body 14 can each have an upper edge 43, that can be part of said peripheral edge 49 that delimits the opening upper end 50. Similarly, the lateral walls 58 of the closing lid 12 can each have a lower edge 53, that can be part of said peripheral edge 61 that delimits the opening lower end 60 (see for example FIGS. 3, 4, 5, 6 and 9). In the closed condition of the closing lid 12, in which the lateral walls 68 are defined overall, the upper 43 and lower 53 edges meet, that is, they are essentially parallel and adjacent with respect to each other (see FIGS. 1 and 2 for example).

In possible forms of embodiment, see FIGS. 1-6, 9 and 11 for example, combinable with all the forms of embodiment described here, the upper edge 43, like the lower edge 53, can be transverse and inclined with respect to the base wall 46 of the external containing body 14.

The inclinations of the upper edge 43 and the lower edge 53 can be coordinated with each other, for example they can both be inclined downward toward the respective front walls 42 and 52, so as to meet in the closed condition of the closing lid 12 (see FIGS. 1 and 2 for example).

The inclination of the upper edge 43 and the lower edge 53 can be chosen for example in an interval between 15° and 60°, in particular between 20° and 45°, more in particular between 25° and 35°. Possible inclination values of the upper edge 43 and the lower edge 53 can be for example 29°, 30°, 31°, 32°, 33°, 34°.

In other possible implementations, the upper edge 43, like the lower edge 53, can instead be parallel to the base wall 46 of the external containing body 14.

In accordance with the present description, the closing lid 12 can be configured so that, in its open condition (FIGS. 3 and 4), it allows the passage of the internal shell 16 from the closed configuration to the open configuration, since it can be rotated into a position where it does not interfere with the sliding of the internal shell 16.

The closing lid 12 can rotate to close and open the opening upper end 40 of the internal shell 16, from which the smoking articles are removed, and also the opening upper end 50 of the external containing body 14, through which the internal shell 16 is slidingly extracted and inserted.

According to the present description, the closing lid 12 is configured to be completely outside the internal shell 16, both in the closed and the open condition (see respectively FIGS. 1, 2 and FIGS. 3, 4).

In particular the closing lid 12 has the front wall 52 and the rear wall 54 external to the corresponding front wall 32 and rear wall 34 of the internal shell 16, just as the lateral walls 58 are disposed externally with respect to corresponding lateral walls 38 of the internal shell 16. To this end, the width and length of the closing lid 12 are greater than the width and length of the internal shell 16.

Furthermore, the closing lid 12 is configured to be completely outside the external containing body 14 as well, both in the closed configuration (FIGS. 1 and 2), and in the open configuration (FIGS. 3 and 4), just as in the open and extracted configuration (FIGS. 5, 6, 15*a*-15*d*, 17*a*-17*c*) of the internal shell 16 and in the intermediate passage configurations between one or the other of said configurations (see FIG. 11 for example).

To this end, the width and length of the closing lid 12 are essentially equal to the width and length of the external shell 11.

Consequently, in the closed condition of the closing lid 12, which also defines the closed configuration of the packet 10, (FIGS. 1 and 2), the front wall 52, the rear wall 54 and the lateral walls 58 of the closing lid 12 are coplanar to the corresponding front wall 42, rear wall 44 and lateral walls 48 of the external containing body 14 of the external shell 11. In this way, when it is closed, the closing lid 12 goes into abutment, for example with its peripheral edge 61, against the external containing body 14, in particular against the peripheral edge 49 that delimits the opening upper end 50, and is not therefore inserted into the external containing body 14.

The passage from the closed configuration to the open and extracted configuration is possible by positioning the closing lid 12 preliminarily in its open condition, so that the opening upper end 50 of the external containing body 14 is opened to allow the extraction of the internal shell 16. The sliding of the latter automatically causes the rotation of the closing lid 12 as well, thanks to the provision of the connection tongue 20, as described above. Indeed, after the closing lid 12 has been opened, it is possible to rotate it automatically, making the internal shell 16 slide with respect to the external containing body 14, since the closing lid 12 is also connected to the external containing body 14 by means of the connection tongue 20.

In accordance with possible forms of embodiment, the connection tongue 20 can be connected both to an external upper edge 45 of the rear wall 44 of the external containing body 14, and also to a closing upper edge 55 of the rear wall 54 of the closing lid 12. In particular the connection tongue 20 can be connected to the upper edge 45 and to the upper edge 55 by means of respective transverse folding lines 84, described in detail hereafter, so as to essentially make said double-jointed articulated connection between closing lid 12 and external containing body 14.

Moreover, in accordance with possible forms of embodiment, the connection tongue 20 can be part of the rear wall 54 of the closing lid 12, from which it can be made and separated by two parallel notches, or incisions 57, made in an intermediate position, which thus define two smaller lateral panels 59 of the rear wall 54 of the closing lid 12, on one side and the other of the connection tongue 20 that is thus created (see FIGS. 2 and 11). Therefore, the connection tongue 20 can be made through these two parallel notches 57, made on the rear wall 54 of the closing lid 12. The portion of rear wall 54 between the two notches 57 that forms the connection tongue 20 is not glued to the internal shell 16, while the portions of the rear wall 54 of the closing lid 12 located at the sides of the notches 57, that is, at the sides of the connection tongue 20, are instead glued to the internal shell 16.

In accordance with some forms of embodiment of the present description, the connection tongue 20 can therefore have a transverse width smaller than the transverse width of the rear wall 54 of the closing lid 12, and therefore also smaller than the length of the hinge 15. For example, the connection tongue 20 can be provided in a central position with respect to the rear wall 54 of the closing lid 12, and so the smaller lateral panels 59 of the rear wall 54 are positioned symmetrically with respect to the connection tongue 20.

In accordance with forms of embodiment described here, the connection tongue 20 can have a length or height equal to the height of the rear wall 54 of the closing lid 12.

More specifically, the proximal connection end 20*a* of the connection tongue 20 is attached to the closing lid 12 in a portion of the edge of the upper wall 51, more precisely along the edge that divides the upper wall 51 of the closing lid 12 from the rear wall 54 of the closing lid 12. The distal connection end 20*b* of the connection tongue 20 is attached to the peripheral edge that defines the access aperture of the external containing body 14. In practice, the connection tongue 20 is attached to the closing lid 12 and to the external containing body 14, while the closing lid 12 is hinged to the internal shell 16. The sliding travel that the internal shell 16 and the wrapper 13 are able to make is therefore equal to the length of the connection tongue 20 plus the height of the rear wall 54 of the closing lid 12, that is, equal to twice the height of the rear wall 54 of the closing lid 12. This limited sliding is sufficient to remove the internal shell 16, together with the wrapper 13, from the external containing body 14, so as to make visible the information possibly printed thereon.

In accordance with possible forms of embodiment, the rear wall 34 of the internal shell 16 can be provided with at least an upper folding flap or tab 34', rotatable around a folding line 34" (see FIGS. 7, 8, 10 and 18*a* for example) and obtained, for example, by means of lateral longitudinal notches or incisions 34". The upper folding flap or tab 34' can be attached to said rear wall 54 of the closing lid 12.

The upper folding flap 34' can therefore be moved away from and toward a lying plane of the rear wall 34 of the internal shell 16.

The upper folding flap 34' can, for example, be rotated toward the outside of the internal shell 16.

In accordance with the present description, the upper folding flap 34' can therefore define the hinge 15 that connects the closing lid 12 rotatably to the internal shell 16 (see FIGS. 7, 8 and 10 for example), in this way allowing both the rotation of the closing lid 12 and also preventing the internal shell 16 from completely exiting from the external containing body 14. Therefore the one or more upper folding flaps 34', and the hinge 15 thus defined, can act as a stopping or holding element to prevent a complete and excessive sliding of the internal shell 16, beyond a partly extracted condition.

Moreover, by also providing a central notch 34'''' essentially parallel to the lateral longitudinal notches or incisions 34'', it is possible to make two adjacent upper folding flaps 34', each rotatable as described above, autonomously one from the other (see FIG. 13 for example), which can therefore carry out the same functions as a single upper folding flap 34'. Therefore, the upper folding flap 34' can be in a single piece, or it can be formed by two parts, attached to the closing lid 12, glued for example.

Consequently, the closing lid 12 can be rotatably connected to the rear wall 34 of the internal shell 16 by connection to one or more upper folding flaps 34', for example by gluing an internal surface of the rear wall 54 of the closing lid 12 to the upper folding flap 34' of the rear wall 34, thus obtaining, as we said, the hinge 15. Alternatively, it can be glued to the two upper folding flaps 34', if provided, of the internal shell 16 (see FIG. 13). In particular, it is possible to insert the upper folding flap/flaps 34' through the opening lower end 60 of the closing lid 12 and glue it/them to the internal surface of the rear wall 54.

The width of the upper folding flap/flaps 34', and possibly of the hinge 15 defined thereby, can therefore correspond to the width of the rear wall 54 of the closing lid 12.

In particular, the folding line 34''' along which the upper folding flap/flaps 34' can be folded can define said hinge 15, and the corresponding lid hinging axis Y, around which the closing lid 12 can rotate. The folding line 34''' can be in correspondence with the hinge 15 and located perpendicularly to the lateral longitudinal notches or incisions 34'', thus forming said upper folding flap 34'. Therefore, the lateral longitudinal notches or incisions 34'' and the folding line 34''' provided on the rear wall 34 allow the closing lid 12 to rotate around the hinge 15.

Moreover, the overall width of the upper folding flap/flaps 34', equal to the width of the rear wall 54, can also correspond, as we said, to the length of the hinge 15.

The closing lid 12 can be attached to the internal shell 16 by gluing the internal face of the rear wall 54 of the closing lid 12 to the upper folding flap 34' of the internal shell 16.

In this way the upper folding flap 34' of the rear wall 34 of the internal shell 16, where the closing lid 12 is glued, can bend along the folding line 34''', when the closing lid 12 is rotated around the hinge 15. In practice, the folding line 34''' coincides with the hinge 15.

When the closing lid 12 is in the closed condition, it forms a rectangular parallelepiped with the external containing body 14. In particular the front wall 52, the rear wall 54 and the two lateral walls 58 of the closing lid 12 are contiguous with the front wall 62, the rear wall 64 and the two lateral walls 68 of the external containing body 14 respectively.

In accordance with possible forms of embodiment, the internal shell 16 can be provided with protruding holding fins, or claws 17, configured to interfere with the closing lid 12, so as to interfere with the internal surface of the lateral walls 58 of the closing lid 12, and thus stably hold the closing lid 12 in its closed condition. The consumer, applying an upward traction force or a downward thrust force on the closing lid 12, can on each occasion easily overcome the resistance of the holding wings 17, to open and close the closing lid 12.

The holding fins 17 can be provided in a lateral position for example. For example, a pair of holding fins 17 can be provided which can be put at the sides of the removal window 39 and positioned so as to interfere with the closing lid 12 when the latter is in the closed condition, in abutment with the peripheral edge, so as to guarantee a more stable closure. For example, the holding fins 17 can be provided along longitudinal edges defined between the lateral walls 38 and the front wall 32, typically in an upper position, in substantial correspondence to the opening upper end 40 of the internal shell 16, for example near the removal window 39. The holding fins 17 can be made, for example, by means of incisions or notches, 18 which, when the lateral walls 38 and the front wall 32 of the internal shell 16 are folded to form the internal shell 16, determine the exit of a flap, or tongue, of material of the internal shell 16, that defines the holding fins 17. Generally, to obtain the protruding effect of the holding fins 17, the incisions or notches 18 can be made slightly curvilinear, or in any case not completely parallel to the longitudinal edges between the lateral walls 38 and the front wall 32.

FIGS. 14 and 20 are used to describe forms of embodiment of a single blank 80 from which it is possible to produce an external shell 11 in accordance with the present description.

In accordance with some forms of embodiment, the single blank 80 can include a first portion 80*a*, intended to form the external containing body 14, and a second portion 80*b*, intended to form the closing lid 12. The second portion 80*b* can include a transverse panel 54' intended to form the rear wall 54 of the closing lid 12. The transverse panel 54' can have two longitudinal notches or incisions 57', corresponding to the notches or incisions 57, that create a central panel 20' intended to form the connection tongue 20. The first portion 80*a* and the second portion 80*b* of the blank 80 are joined together by means of the central panel 20' alone.

The single blank 80 can include a plurality of elements that are described using, where possible, the same reference numbers, with apostrophe(s), of the corresponding walls of the external shell 11.

With reference, for example, to FIGS. 14 and 20, the blank 80 can be provided with two longitudinal folding lines 82 and with a plurality of transverse folding lines 84, which define, between the longitudinal folding lines 82, a panel 42' that forms the front wall 42 of the external containing body 14; a panel 44' that forms the rear wall 44 of the external containing body 14; a panel 46' that forms the base wall 46 of the external containing body 14; a panel 51' that forms the upper wall 51 of the closing lid 12; a panel 52' that forms the front wall 52 of the closing lid 12; a transverse panel 54' that forms the rear wall 54 of the closing lid 12; a reinforcement panel 52'' that is folded at 180° and glued to the panel 52'; reinforcement panels 51'' that are folded at 180°, rotated toward the inside and glued to the panel 51'.

The panel 42' can be provided with two lateral wings 48', that form respective external portions 48*a* of the lateral walls 48 of the external containing body 14 (FIG. 12), disposed on opposite sides of the panel 42', connected to the panel 42' by the longitudinal folding lines 82.

The panel 44' can be provided with two lateral wings 48", that form respective internal portions 48*b* of the lateral walls 48 of the external containing body 14 (FIG. 12), disposed on opposite sides of the panel 44', connected to the panel 44' by the longitudinal folding lines 82.

The panel 46' is disposed between the panel 44' and the panel 42'. The panel 46' can be provided with two lateral reinforcement wings 46", that are folded at 180°, rotated toward the inside and glued to the panel 46', disposed on opposite sides of the panel 46', connected to the lateral wings 48" by transverse folding lines 84 and separated from the panel 46' and from the lateral wings 48' by means of respective incisions or notches 46" and 46".

The panel 52' can be provided with two lateral wings 58', that form respective external portions 58*a* of the lateral walls 58 of the closing lid 12 (FIG. 13), disposed on opposite sides of the panel 52', connected to the panel 52' by the longitudinal folding lines 82. The lateral wings 58' can have a trapezoidal shape for example.

The transverse panel 54' can have two pairs of notches or incisions, including said two longitudinal notches or incisions 57' and two transverse notches or incisions 57" that form both the central panel 20', that defines the connection tongue 20, and two lateral panels 59', that define the smaller lateral panels 59. Each pair of notches or incisions 57', 57" provide a longitudinal notch 57' and a transverse notch 57", respectively parallel or aligned to the longitudinal folding lines 82 and to the transverse folding lines 84. Typically, the longitudinal notch 57' and the transverse notch 57" are reciprocally disposed essentially at 90°, with an "L" conformation, and each pair of notches 57', 57" can be symmetrical to the other with respect to the central panel 20'. The central panel 20' is connected to the panel 51' and to the panel 44' by means of transverse folding lines 84 and is separated from the lateral panels 59' by means of the longitudinal notches 57'. Moreover, the lateral panels 59' are connected to the panel 51' by means of transverse folding lines 84 and are separated from the panel 44' by means of the transverse notches 57".

The transverse panel 54' can also be provided with two lateral wings 58", that form respective internal portions 58*b* of the lateral walls 58 of the closing lid 12 (FIG. 13), disposed on opposite sides of the transverse panel 54'. The lateral wings 58" and the reinforcement panels 51", glued, after suitable folding, respectively to the two lateral wings 58' and the panel 51', allow to reinforce the lateral walls 58 and the upper wall 52 of the closing lid 12.

The lateral wings 58" are connected to the transverse panel 54' by the longitudinal folding lines 82 and are separated, or able to be separated, from the lateral wings 48" by incisions, or notches, or breaking lines 48". The incisions, or notches or breaking lines 48" can define said upper edges 43 of the lateral walls 48 of the external containing body 14, and can possibly be made inclined, to provide an inclination to said upper edges 43. Consequently, the incisions, or notches, or breaking lines 48'", together with the longitudinal notches or incisions 57' and transverse notches or incisions 57" can be provided to separate the first portion 80*a* of the blank 80 from the second portion 80*b* of the blank 80 which, as we said, can remain joined only by means of the central panel 20' that creates said connection tongue 20.

The reinforcement panels 51" can be connected to the lateral wings 58" by transverse folding lines 84 and separated from the lateral wings 58' and the panel 51' by respective incisions or notches 51'" and 51"".

The transverse panel 54' intended to form the rear wall 54 of the closing lid 12 has the two longitudinal notches 57' that create the connection tongue 20. Therefore, the second portion 80*b* intended to become the closing lid 12 and the first portion 80*a* intended to become the external containing body 14 are separated along incisions or notches or breaking lines 48'" until arriving at the longitudinal notches 57'. In practice, the portion central to the longitudinal notches 57' made on the transverse panel 54', intended to form the rear wall 54 of the closing lid 12, is not detached, leaving in that zone, where the connection tongue 20 is created, the link between the first portion 80*a* and the second portion 80*b*. The portion of rear wall 54 of the closing lid 12 that forms the connection tongue 20, as we said before, will not be glued, while the portions of the transverse panel 54' at the sides of the connection tongue 20 will be glued to the two portions that form the upper folding flap 34' of the internal shell 16.

In possible implementations, the folding lines 34'", 82, 84 according to the present description can be made for example by pre-creasing the relatively rigid material that makes up the external shell 11 and the internal shell 16. For example, blind or continuous pre-creasing operations can be provided, or through pre-creasing or in segments. According to the present description, by blind pre-creasing we mean a shaping made with a deformation by crushing the thickness of the material, and by through pre-creasing we mean a shaping in which at least one cut segment is provided passing through the thickness of the material.

In possible implementations, the notches or incisions 18, 34", 34"", 46'", 46"", 48'", 51'", 51"", 57', 57" can be made for example by dinking or cutting the relatively rigid material that makes up the external shell 11 and the internal shell 16.

It is therefore clear from the above that, from a single blank 80 the external shell 11 can be made, including the closing lid 12, the external containing body 14 and the connection tongue 20.

It is also obvious that the single blank 80 from which, in a single body, the closing lid 12, the external containing body 14 and the connection tongue 20 are made, is a blank that can be processed without difficulty to produce rigid packets of the hinged-lid, slide-open type in conventional packaging machines, without requiring substantial modifications or adaptations thereof, with the additional provision of making the longitudinal notches 57' and the transverse notches 57" as above, to define the central panel 20' and hence the corresponding connection tongue 20 of the final external shell 11.

For example, the blank 80 according to the present description and described using FIGS. 14 and 20 can be made of a relatively rigid sheet material, such as cardboard, paper or suchlike.

Figure 19:
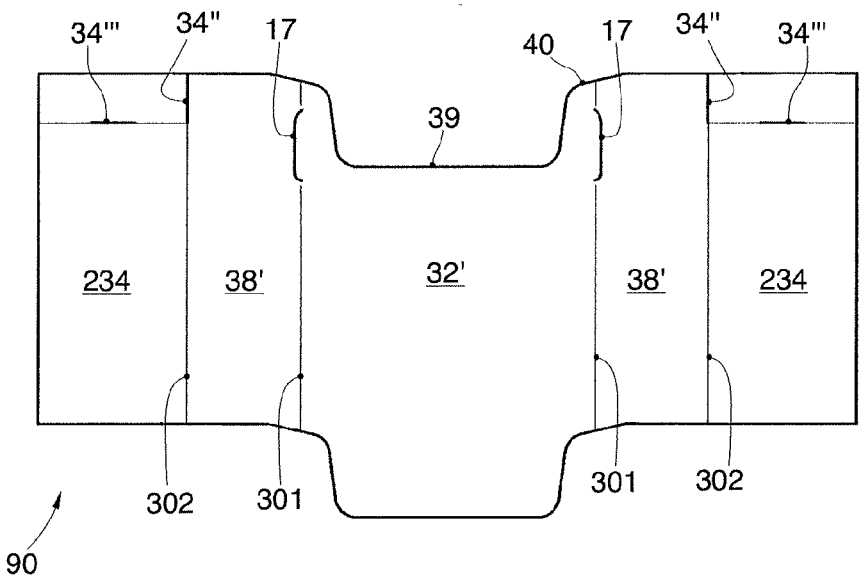
FIG. 19 shows a blank of an internal shell for a packet according to forms of embodiment described here.

FIG. 19 is used to describe forms of embodiment of a single blank 90 usable to make the internal shell 16 that is folded around the wrapper 13. The blank 90 comprises: a main panel 32' that constitutes the front wall 32 of the internal shell 16; two panels 38' that constitute the lateral walls 38 of the internal shell 16, are disposed on opposite sides of the main panel 32', and are divided from the main panel 32' by two longitudinal lines of weakening 301; and two panels 234 that together constitute the rear wall 34 of the internal shell 16, are disposed at the sides of the two panels 38' and are divided from the panels 38' by a respective longitudinal line of weakening 302. The lateral longitudinal notches or incisions 34" are made along the longitudinal lines of weakening 302 that divide the panels 234, that form the rear wall 34 of the internal shell 16, from the adjacent panels 38' that form the lateral walls 38 of the internal shell 16. In the same way, the folding line 34''' is made on the panels 234 so as to form the upper folding flap 34' divided into two portions, one for each panel 234, which will then be glued to the rear wall 54 of the closing lid 12. The main panel 32' has the removal window 39, for example defined by a U-shaped cut. The blank 90 is folded around the wrapper 13 and attached to it.

Figure 5:
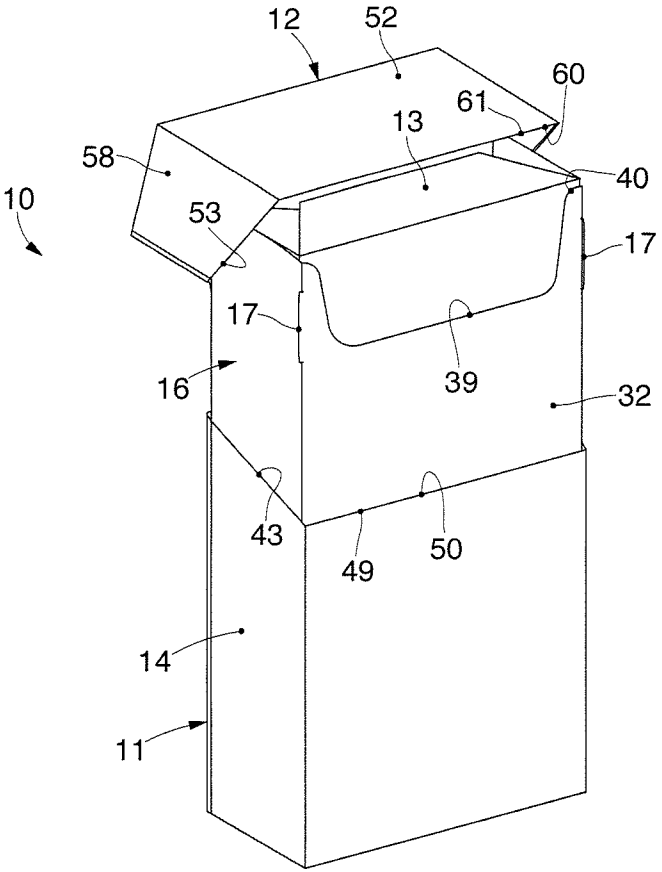
FIG. 5 is a front perspective view of a packet in accordance with forms of embodiment described here, in an open and extracted condition.

Furthermore, it is obvious that the packet 10 according to the present description can be attractive both for conservative smokers, in that it can be used as a traditional packet when put in the open configuration (FIGS. 3 and 4), and also for innovative smokers, when put in the open and extracted configuration (FIGS. 5 and 6).

Furthermore, the internal 11 and external shells 16 used are easily processed by traditional packaging machines.

Moreover, since the internal shell 16 is essentially comparable to that of traditional packets, except for the possible inclusion of the upper folding flap 34 as above, it is quite evident that the same internal shell 16 maintains its characteristics of resistance and rigidity that make traditional packets appreciated by many smokers.

It is clear that modifications and/or additions of parts may be made to the packet 10 as described heretofore, without departing from the field and scope of the present invention.

It is also clear that, although the present invention has been described with reference to some specific examples, a person of skill in the art shall certainly be able to achieve many other equivalent forms of packet 10, having the characteristics as set forth in the claims and hence all coming within the field of protection defined thereby.

Although the above refers to forms of embodiment of the invention, other forms of embodiment can be provided without departing from the main field of protection, which is defined by the following claims.

The invention claimed is:

1. A packet for smoking articles, comprising:

an external shell with an access aperture; and an internal shell to contain smoking articles provided with a rear wall comprising one or more upper folding flaps delimited by a folding line, wherein the external shell comprises:

an external containing body, a closing lid hinged to the internal shell by means of a hinge defined by said folding line and able to position itself between an open condition in which it allows access to the smoking articles contained in the internal shell, and a closed condition, in which it closes said access aperture of the external shell, said closing lid being provided with a rear wall, two opposite lateral walls and a front wall which is opposite the rear wall when the closing lid is in the closed condition, and a connection tongue configured to connect the closing lid to the external containing body, said connection tongue being part of said rear wall of the closing lid and being delimited laterally by two incisions, or notches which define one or more smaller lateral panels of the rear wall of the closing lid, said one or more smaller lateral panels being attached to said one or more upper folding flaps and rotatable around said folding line which said hinge defines, wherein the internal shell is configured to slide, with respect to the external containing body, between a closed configuration, where the internal shell is completely inserted inside the external shell and where the closing lid is, in its closed condition, completely outside both the internal shell and the external containing body, and an open and extracted configuration where the internal shell is partly extracted from the external containing body, and the external containing body, the closing lid, and the connection tongue which form the external shell have no other functional apertures to put said internal shell in said open and extracted configuration.

2. The packet for smoking articles as in claim 1, wherein the connection tongue is configured to define a double-jointed articulated connection of the closing lid to the external containing body.

3. The packet for smoking articles as in claim 1, wherein the external containing body, the closing lid and the connection tongue which form the external shell constitute a single body obtained from a single blank.

4. The packet for smoking articles as in claim 1, wherein the front wall, the rear wall and the lateral walls of the closing lid are coplanar to a corresponding front wall, rear wall and lateral walls of the external containing body, in the closed condition of the closing lid.

5. The packet for smoking articles as in claim 1, wherein the lateral walls of the external containing body have inclined upper edges and the lateral walls of the closing lid have inclined lower edges, mating with said upper edges.

6. The packet for smoking articles as in claim 1, wherein said connection tongue has a transverse length shorter than the transverse length of the rear wall of the closing lid.

7. The packet for smoking articles as in claim 1, wherein the length of the hinge corresponds to the width of the rear wall of the closing lid.

8. A single blank to make a packet for smoking articles as in claim 1, said blank comprising, in a single body, a first portion intended to form an external containing body of said packet, and a second portion, intended to form a closing lid, said second portion comprising a transverse panel, two lateral panels and a front panel intended to form a rear wall, two lateral wall and a front wall of the closing lid respectively, the transverse panel being provided with two notches, or incisions, that create a central panel intended to form a connection tongue to connect the closing lid to the external containing body and one or more lateral panels intended to form one or more smaller lateral panels of the rear wall of the closing lid in order to attach the closing lid to the internal shell, wherein said first portion and said second portion are joined only by means of said central panel.

9. The packet for smoking articles as in claim 1, wherein said two incisions, or notches define two smaller lateral panels of the rear wall of the closing lid, on one side and the other of the connection tongue, each said smaller lateral panel being adjacent and contiguous to a respective lateral wall of the closing lid.

* * * * *